US007734219B2

(12) United States Patent
Tanaka et al.

(10) Patent No.: US 7,734,219 B2
(45) Date of Patent: Jun. 8, 2010

(54) UNIT, IMAGE FORMING APPARATUS, AND METHOD OF MANUFACTURING UNIT FRAME

(75) Inventors: Shuji Tanaka, Tokyo (JP); Takatsugu Fujishiro, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 443 days.

(21) Appl. No.: 11/596,204

(22) PCT Filed: Mar. 8, 2006

(86) PCT No.: PCT/JP2006/305067

§ 371 (c)(1),
(2), (4) Date: Nov. 13, 2006

(87) PCT Pub. No.: WO2006/098343

PCT Pub. Date: Sep. 21, 2006

(65) Prior Publication Data

US 2008/0260426 A1 Oct. 23, 2008

(30) Foreign Application Priority Data

Mar. 14, 2005 (JP) ..... 2005-071049

(51) Int. Cl.
*G03G 15/20* (2006.01)

(52) U.S. Cl. ..... 399/123; 399/117; 399/351

(58) Field of Classification Search ..... 399/123, 399/116, 117, 107, 110, 111, 351
See application file for complete search history.

(56) References Cited

U.S. PATENT DOCUMENTS 4,766,455 A * 8/1988 Carter ..... 399/116
5,608,509 A * 3/1997 Shirai et al. ..... 399/351
7,010,246 B2 3/2006 Fujishiro et al.

FOREIGN PATENT DOCUMENTS

| | | |
|---|---|---|
| CN | 1252544 A | 5/2000 |
| JP | 64-34659 | 3/1989 |
| JP | 01-303480 | 12/1989 |
| JP | 02-219080 | 8/1990 |
| JP | 05-273897 | 10/1993 |
| JP | 07-319350 | 12/1995 |
| JP | 10-003237 | 1/1998 |
| JP | 11-237821 | 8/1999 |
| JP | 2000-131945 | 5/2000 |
| JP | 3110581 | 9/2000 |

(Continued)

*Primary Examiner*—David P Porta
*Assistant Examiner*—Benjamin Schmitt
(74) *Attorney, Agent, or Firm*—Oblon, Spivak, McClelland, Maier & Neustadt, L.L.P.

(57) ABSTRACT

A structure which increases positioning precision of a blade member to a rotating member, an image forming apparatus, and a method of manufacturing a unit frame. A first reference surface of a boss provided on a surface of a frame to which a blade is contacted is formed by a first mold that forms a positioning hole for positioning a rotating member. The first reference surface supports the blade member to prevent the blade member from moving to a weight direction. With this arrangement, there is no manufacturing error of the first reference surface due to a mold assembling error. As a result, precision of positioning the blade member to the rotating member can be increased.

7 Claims, 8 Drawing Sheets

FOREIGN PATENT DOCUMENTS

| | | |
|---|---|---|
| JP | 2002-072914 | 3/2002 |
| JP | 2002-156891 | 5/2002 |
| JP | 2002-328583 | 11/2002 |
| JP | 2003-054052 | 2/2003 |
| JP | 2003-156946 | 5/2003 |
| JP | 2004-117696 | 4/2004 |
| JP | 2004-177935 | 6/2004 |
| JP | 2005-043485 | 2/2005 |
| WO | WO 2004/025375 A2 | 3/2004 |

* cited by examiner

UNIT, IMAGE FORMING APPARATUS, AND METHOD OF MANUFACTURING UNIT FRAME

TECHNICAL FIELD

The present invention relates to an image forming apparatus, and more particularly, to a unit-constituting an image forming apparatus, an image forming apparatus including the unit, and a method of manufacturing a unit frame.

BACKGROUND ART

Conventionally, in an image forming apparatus, a cleaning blade is used to clean a transfer residual toner remaining on a surface of a rotating member, which is a photosensitive element, after an image transfer process (for example, Patent Documents 1 and 2). The cleaning blade is disposed to extend in a longitudinally parallel direction with respect to the rotating member and arranged so as to contact with the rotating member or to have a predetermined distance from the rotating member.

In recent years, high quality is strongly demanded for an image formed by electrophotographic image forming apparatuses. To improve the image quality, it is effective to decrease the size of toners and to form the toners in a spherical shape. A toner (hereinafter, "spherical toner") having substantially a spherical shape formed by polymerization is becoming the mainstream. The spherical toner has higher transfer efficiency than a conventional powder toner (irregular-shaped toner), and is known to meet the recent demand for high image quality. However, the spherical toner increases Van der Waals force to the photosensitive element, thereby increasing adhesive force to the photosensitive element. Therefore, contact pressure of the conventional cleaning blade applied on the photosensitive element to clean the powder toner is not sufficient enough to scrape off the residual toner on the photosensitive element. By increasing contact pressure of the cleaning blade on the photosensitive element, the residual toner on the photosensitive element can be scraped off. However, when the contact pressure is too high, frictional force between the cleaning blade and the photosensitive element increases. Consequently, a front end of the cleaning blade is curled or vibrated, thereby generating a small gap between the cleaning blade and the photosensitive element. Since a polymer toner is very small, there is a possibility that the polymer toner passes by the cleaning blade even if the gap is very small. Accordingly, to prevent the curling of the front end and to satisfactorily scrape off the residual toner, the cleaning blade needs to be brought into contact with the photosensitive element in high precision, thereby obtaining an appropriate contact pressure.

Conventionally, the cleaning blade is installed in a cleaning case including a collecting unit that collects toner scraped off by the cleaning blade. This cleaning case is installed on a cover (a frame) that supports the photosensitive element, thereby positioning the cleaning blade on the photosensitive element (for example, Patent Document 3). At the time of positioning the cleaning blade on the photosensitive element by installing the cleaning case on the cover, it has been difficult to bring the cleaning blade into contact with the photosensitive element in high precision, due to an assembling error between the cleaning blade and the cleaning case and between the cleaning case and the frame.

The applicant of the present invention has developed a unit that directly mounts a cleaning blade on a frame that supports a photosensitive element, to increase the precision of bringing the cleaning blade into contact with the photosensitive element. FIG. 14 is a perspective view of relevant parts of the unit. As shown in FIG. 14, a frame 500 that supports a photosensitive element 2 has a positioning hole 503 for positioning the photosensitive element 2 within the frame, on a side plate 500*a*. A bearing 504 is engaged with this positioning hole 503. The frame 500 supports the photosensitive element 2, by inserting a rotation axis 2*a* of the photosensitive element into the bearing 504. The frame 500 has a blade contact surface 501 that extends from this side toward the back in FIG. 14 and to which a cleaning blade 11 is brought into contact. A boss 502 as a blade positioning unit that positions the cleaning blade 11 is provided on the contact surface 501. Since the cleaning blade 11 is brought into contact with the contact surface 501 of the frame 500, a contact angle with the photosensitive element 2 is kept at a predetermined angle. The cleaning blade 11 is positioned on the boss 502 provided on the frame 500 that supports the photosensitive element 2. The cleaning blade that is positioned by being directly fit to the frame that supports the photosensitive element is superior to the conventional cleaning blade that is positioned by being indirectly fit to the frame via the cleaning case in that there is no assembling error between the cleaning case and the cleaning blade. Therefore, the precision of bringing the cleaning blade 11 into contact with the photosensitive element 2 can be increased, as compared with the conventional method.

Patent Document 1: Japanese Patent Application Laid-open No. 2004-117696

Patent Document 2: Japanese Patent Application Laid-open No. 2004-177935

Patent Document 3: Japanese Patent Application Laid-open No. 2002-328583

DISCLOSURE OF INVENTION

Problem to be Solved by the Invention

However, according to the unit shown in FIG. 14, while the positioning hole 503 that positions the photosensitive element within the frame is manufactured by a mold that moves in a direction A in FIG. 14, the boss 502 is manufactured by a mold that moves in a direction B in FIG. 14. Therefore, due to an assembling error between the mold that moves in the direction A and the mold that moves in the direction B in FIG. 14, a manufacturing error occurs in a positional relationship between the positioning hole 503 and the boss 502. As a result, precision of positioning the cleaning blade 11 on the photosensitive element 2 becomes poor. Consequently, the cleaning blade 11 cannot be brought into contact with the photosensitive element 2 in high precision.

The above problem is not limited to the photosensitive element and the cleaning blade. For example, a doctor blade as a blade member that must be disposed keeping a predetermined gap with a developing rotating member also has a possibility of facing a similar problem. An isolation plate as a blade member that must be disposed with a predetermined gap from a fixing rotating member as a rotating member also has a possibility of facing a similar problem.

The present invention has been achieved in view of the above problems. It is an object of the present invention to provide a unit that can increase positioning precision of a blade member to a roller, an image forming apparatus, and a method of manufacturing a unit frame.

Means for Solving Problem

To solve the above problems and to achieve the above object, the present invention provides a unit including a rotating member; a blade arranged to extend substantially parallel to a direction of length of the rotating member so as to contact the rotating member or to keep a predetermined distance from the rotating member; and a frame to which the rotating member and the blade are installed. The frame includes a rotating member positioning unit configured to position the rotating member at a predetermined position; and a blade positioning unit configured to position the blade at a predetermined position. The rotating member positioning unit and the blade positioning unit are formed with an identical mold.

Moreover, the present invention provides the unit in which the frame includes a side plate, and the rotating member positioning unit is provided on the side plate. The blade positioning unit includes a projecting portion that projects from a surface of the frame extending in a direction of length of the frame. A supporting surface of the projecting portion on which the blade is supported so as to prevent the blade from being moved toward a direction of gravity has a substantially constant height in a direction of length or has a height gradually lowered toward the side plate.

Furthermore, the present invention provides the unit according to claim 1, in which a surface of the blade is arranged to closely contact a surface of the frame extending in a direction of length.

Moreover, the present invention provides the unit in which the blade includes an elastic member; and a holding member configured to hold the elastic member. The holding member includes a surface arranged to be closely contact a surface of the frame extending in a direction of length, and the elastic member is fixed on the surface of the frame.

Furthermore, the present invention provides the unit in which the rotating member includes an image carrier configured carry a toner image on a surface of the rotating member. The blade is configured to clean residual toner remaining on the surface of the image carrier after an image transfer process.

Moreover, the present invention provides the unit in which the image carrier has a belt shape.

Furthermore, the present invention provides an image forming apparatus that includes a unit that has an image carrier of which a surface moves while holding a toner image on the surface, and a cleaning blade that cleans residual toner remaining on the surface after an image transfer process. The unit is detachably arranged in the image forming apparatus.

Moreover, the present invention provides an image forming apparatus including the unit in which the rotor functions as an image carrier of which a surface moves while carrying a toner image on the surface, and the blade functions as a cleaning blade that cleans residual toner remaining on the surface of the image carrier after an image transfer process. The unit is detachably arranged in the image forming apparatus.

Furthermore, the present invention provides the image forming apparatus including the unit in which the rotor functions as an image carrier of which surface moves while carrying a toner image on the surface, and the blade functions as a cleaning blade that cleans residual toner remaining on the surface of the image carrier after an image transfer process. The image carrier has a belt shape.

Moreover, the present invention provides the image forming apparatus in which a toner that forms the toner image is a polymer toner.

Furthermore, the present invention provides a method of manufacturing a unit frame to which a rotating member and a blade are installed. The unit frame is arranged to extend substantially parallel to a direction of length of the rotating member and to contact the rotating member or to keep a predetermined distance from the rotating member. A rotating member positioning unit configured to position the rotating member and a blade positioning unit configured to position the blade member are manufactured using an identical mold.

Moreover, the present invention provides the method of manufacturing a unit frame in which the rotating member positioning unit is formed on a side plate of the unit frame, and the blade positioning unit is formed in a projecting portion that projects from a surface of the unit frame extending in the direction of length. At least a supporting surface of the projecting portion on which the blade is supported so as to prevent the blade from being moved toward a direction of gravity has a substantially constant height in a direction of length or has a height gradually lowered toward the side plate is formed with the mold used to form the rotating member positioning unit.

Furthermore, the present invention provides the method in which a surface of the projecting portion positioned on a side plate of the unit fame is formed with the mold to form the rotating member positioning unit.

EFFECT OF THE INVENTION

According to the present invention, positioning precision of a blade positioning unit and a rotating member positioning unit can be increased.

EXPLANATIONS OF LETTERS OR NUMERALS

Figure 1:
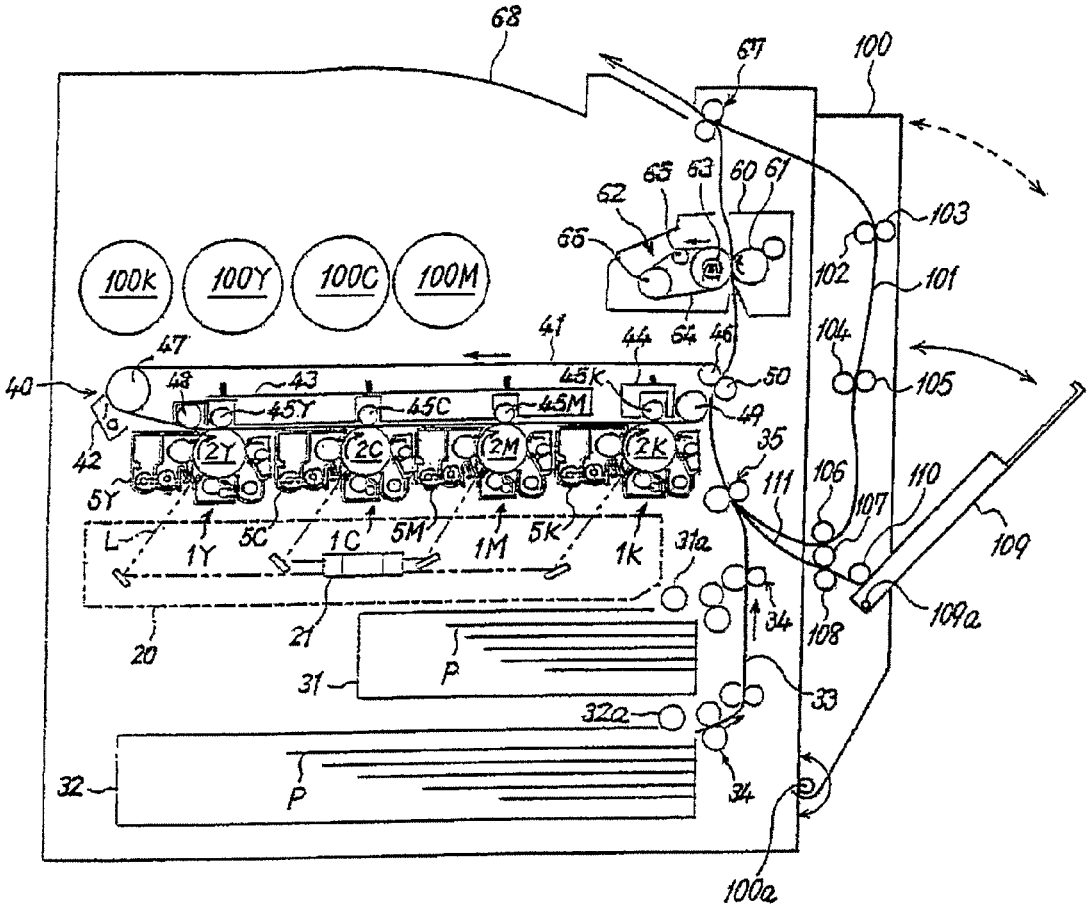
FIG. 1 is a schematic of a printer according to an embodiment of the present invention.

1 Process unit
2 Photosensitive element (Rotating member)
3 Cleaning device
4 Charger
5 Developing device

6 Lubricant coating device
11 Cleaning blade (Blade member)
12 Holding plate
13 Collecting unit
40 Transfer unit
41 Intermediate transfer belt
151 First mold
152 Second mold
210 Frame
220 First side plate
221 First contact surface
222 First positioning hole
227 First boss
250 Second side plate
251 Second blade contact surface
252 Second positioning hole
257 Second boss

BEST MODE(S) FOR CARRYING OUT THE INVENTION

Exemplary embodiments according to the present invention will be explained in detail with reference to the accompanying drawings. A case of an electrophotographic printer (hereinafter, "printer") is explained as an image forming apparatus according to an embodiment of the present invention.

FIG. 1 is a schematic of the printer. As shown in FIG. 1, the printer includes four process units 1Y, 1C, 1M, and 1K that generate a toner image of yellow (Y), magenta (M), cyan (C), and black (K). These process units use Y, C, M, and K toners of different colors as image forming substances that are used to form an image, and have similar configurations. These toners are replaced when their life ends. Since the process units 1Y, 1C, 1M, and 1K have the same configurations, reference symbols of Y, C, M, and K that indicate respective colors are omitted in the following explanation.

Figure 2:
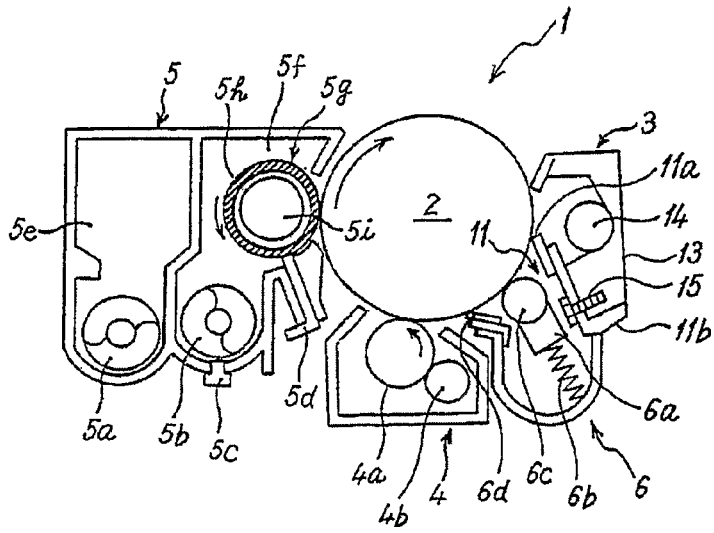
FIG. 2 is an enlarged view of a process unit.

As shown in FIG. 2, a process unit 1 has a drum-shaped photosensitive element 2, a drum cleaning device 3, a charger 4, a developing device 5, and a lubricant coating device 6 that are accommodated in a frame (not shown). The process unit 1 is detachable from the printer, and consumable parts can be replaced at one time.

The charger 4 uniformly charges the surface of the photosensitive element 2 that is rotated in a clockwise direction by a driving unit (not shown). FIG. 1 illustrates the non-contact charge rotating member type charger 4 that uniformly charges the photosensitive element 2 by keeping a charge rotating member 4*a*, rotated in a counterclockwise direction, in non-contact with the photosensitive element 2, while being applied with a charge bias by a power source (not shown). For the charger 4, a scorotron type, a corotron type, a contact rotating member type, and the like can be also used in addition to the non-contact charge rotating member type. However, the scorotron type generates ozone at the discharge time, and is not therefore preferable from the viewpoint of environment. The corotron type, and the contact and the non-contact rotating member types generate little ozone, and the contact and the non-contact rotating member types that can suppress generation of ozone are preferable. In comparing a contact type charge rotating member system with a non-contact type charge rotating member system, since the latter system is not brought into contact with the photosensitive element 2, it can suppress adhesion of a transfer residual toner, and is superior to the contact type charge rotating member system from the viewpoint of remains on the charge rotating member 4*a*.

A system that applies a charge bias to the contact and the non-contact type charge rotating members 4*a* includes a system that superimposes an alternating current to a direct current and a system that applies only a direct current. The charge bias for superimposing an alternating current on a direct current in the contact type charge rotating member 4*a* has an advantage in that, by controlling the alternating current as a constant current, the surface potential of the charge rotating member 4*a* does not receive the influence of resistance of the charge rotating member 4*a* even when the resistance changes due to an environmental change. However, the cost of a power supply device becomes high, and an alternating current frequency has noise. On the other hand, according to the charge bias for superimposing an alternating current on a direct current in the non-contact type charge rotating member 4*a*, the surface of the photosensitive element cannot be charged uniformly due to the influence of a variation in the gap between the photosensitive element 2 and the charge rotating member 4*a*, thereby making the image irregular. Therefore, a charge bias correcting unit that performs correction according to the gap variation is necessary.

According to the system that applies only a direct current, when the resistance of the charge rotating member 4*a* changes due to the environmental change, both the non-contact type system and the contact type system directly receive the influence of this resistance change, and the surface potential of the charge rotating member 4*a* changes. Therefore, a charge bias correcting unit that performs correction according to the environment change becomes necessary.

A charge bias correcting unit includes a temperature detector and an application voltage switching unit near the charge rotating member 4*a*. Based on a result of detection by the temperature detector, the switching unit switches the application voltage, thereby correcting a charge bias. Alternatively, scumming on the photosensitive element 2 can be periodically detected, and the application voltage can be switched based on a result of the detection, thereby correcting the charge bias.

Based on these methods, the surface of the charge rotating member 4*a* is charged at about −500 volts to −700 volts.

The charge rotating member 4*a* can be rotated together with the photosensitive element 2, or can be rotated by using a drive force from a driving source of the photosensitive element 2 via a gear. A low-speed apparatus generally drives the charge rotating member 4*a* together with the photosensitive element 2. A high-speed apparatus requiring high image quality generally uses the latter method.

In the examples shown in FIG. 2, a charge rotating member cleaner 4*b* that cleans the surface of the charge rotating member 4*a* is provided. Based on this, a failure in charging the photosensitive element 2 at a target potential due to a matter adhered to the charge rotating member 4*a* can be suppressed. As a result, an abnormal image due to a charge failure can be suppressed. The charge rotating member cleaner 4*b* is generally configured by melanin, and is rotated together with the charge rotating member 4*a*.

The developing device 5 has a first agent accommodating unit 5*e* disposed with a first conveyor screw 5*a*. The developing device 5 also has a second agent accommodating unit 5*f* disposed with a toner concentration sensor (hereinafter, "T sensor") 5*d* made of a permeability sensor, a second conveyor screw 5*b*, a developing rotating member 5*g*, and a doctor blade 5*d*. Each of the two agent accommodating units includes a developing agent (not shown) containing a magnetic carrier and a negative-charge toner. The first conveyor screw 5*a* is rotated by a driving unit (not shown), thereby conveying the developing agent within the first agent accommodating unit 5*e* from this side toward the back in FIG. 2. The developing agent enters the second agent accommodating unit 5*f* after passing through a communication opening (not shown) formed on a partition wall between the first agent accommodating unit 5*e* and the second agent accommodating unit 5*f*. The second conveyor screw 5*b* within the second agent accommodating unit 5*f* is rotated by a driving unit (not shown), thereby conveying the developing agent from the back toward this side in FIG. 2. The T sensor 5*c* fixed to the bottom of the second agent accommodating unit 5 detects the toner concentration of the developing agent that is being conveyed. The developing rotating member 5*g* that includes a magnet rotating member 5*i* within a nonmagnetic pipe 5*h* that is rotated in the counterclockwise direction in FIG. 1 is disposed in parallel above the second conveyor screw 5*b* that conveys the developing agent in this way. The developing agent conveyed by the second conveyor screw 5*b* is brought to the surface of the nonmagnetic pipe 5*h* by the magnetic force generated by the magnet rotating member 5*i*. The doctor blade 5*d* disposed to keep a predetermined distance from the nonmagnetic pipe 5*h* restricts the layer thickness of the developing agent, and the developing agent is conveyed to a developing area facing the photosensitive element 2, thereby adhering the toner to an electrostatic image on the photosensitive element 2. Based on this adhesion, a Y toner image is formed on the photosensitive element 2. The developing agent of which toner is consumed by the development is returned onto the second conveyor screw 5*b* following the rotation of the nonmagnetic pipe 5*h* of the developing rotating member 5*g*. After the developing agent is conveyed to the front end in FIG. 2, the developing agent is returned to the first agent accommodating unit 5*e* through the communication opening (not shown).

The permeability of the developing agent detected by the T sensor 5*c* is sent as a voltage signal to a controtating member (not shown). The permeability of the developing agent indicates correlation with the toner concentration of the developing agent. Therefore, the T sensor 5*c* outputs a voltage corresponding to the toner concentration. The controtating member has a random access memory (RAM) that stores data of Vtref as a target value of an output voltage from the T sensor 5*c*. The developing device 5 compares the output voltage from the T sensor 5*c* with Vtref, and drives a toner supply device (not shown) during a period of time corresponding to the result of the comparison. Based on this driving, a proper quantity of toner is supplied from the first agent accommodating unit 5*e* to the developing agent of which toner concentration has decreased as a result of the consumption of the toner used for the development. Based on this arrangement, the toner concentration of the developing agent within the second agent accommodating unit 5*e* is maintained at a predetermined level.

The cleaning device 3 removes the transfer residual toner that remains on the surface of the photosensitive element 2 without being transferred, from the surface of the photosensitive element 2. The cleaning device 3 has the cleaning blade 11 as a blade member that is brought into contact with the surface of the photosensitive element in a counter direction. The cleaning blade 11 includes an elastic plate 11*a* made of urethane rubber or the like, and a holding plate 11*b* that holds the elastic plate 11*a*. The cleaning device 3 has a collecting unit 13 that recovers the transfer residual toner that remains on the surface of the photosensitive element 2 that is removed by the cleaning blade 11. The collecting unit 13 has a conveyor auger 14 that conveys the toner recovered by the collecting unit, to a waste toner bottle (not shown). The holding plate 11*b* fixes the collecting unit 13 with a screw 15 at approximately the center of the holding plate 11*b* in the axial direction.

The cleaning blade 11 removes the transfer residual toner on the surface of the photosensitive element 2. The transfer residual toner that remains on the front end of the cleaning blade 11 drops to the collecting unit 13. The conveyor auger 14 conveys the dropped toner as waste toner to the waste toner bottle (not shown) to store the waste toner in the toner bottle. A serviceman collects the waste toner stored in the waste toner bottle. The transfer residual toner recovered in the collecting unit 13 can be conveyed, as a recycle toner, to the developing device 5, and can be used for the development again.

The lubricant coating device 6 decreases the friction coefficient of the surface of the photosensitive element 2 by coating a lubricant onto the surface of the photosensitive element. The lubricant is formed as a solid lubricant 6*a*, and this solid lubricant 6*a* is pressed against a fur brush 6*c* that is rotated by a pressing spring 6*b*, thereby coating the solid lubricant 6*a* onto the surface of the photosensitive element 2 via the fur brush 6*c*. Zinc stearate (ZnSt) is most generally used as the lubricant. Insulation PET, conductive PET, an acrylic fiber, and the like are used for the fur brush 6*c*. The lubricant coated onto the surface of the photosensitive element is fixed to the surface of the photosensitive element in a uniform thickness by being pressed by a lubricant coating blade 6*d*. When the lubricant is coated on the surface of the photosensitive element 2, filming of the photosensitive element 2 can be prevented.

As shown in FIG. 1, an optical writing unit 20 is disposed below the process units 1Y, 1C, 1M, and 1K. The optical writing unit 20 as a latent image forming unit irradiates a laser light L emitted based on image information to each photosensitive element of the process units 1Y, 1C, 1M, and 1K. With this arrangement, an electrostatic latent image for Y, C, M, and K is formed on the photosensitive elements 2Y, 2C, 2M, and 2K. The optical writing unit 20 irradiates the laser light L emitted from a light source to the photosensitive elements 2Y, 2C, 2M, and 2K via plural optical lenses and mirrors while polarizing the laser light L by a polygon mirror 21 rotated by a motor.

A first paper feed cassette 31 and a second paper feed cassette 32 are disposed in superposition in a vertical direction below the optical writing unit 20 in FIG. 1. Plural pieces of transfer paper P as a recording medium are accommodated as a bundle of transfer paper within these paper feed cassettes. The top sheet of transfer paper P is brought into contact with a first paper feed rotating member 31*a*, and a second paper feed rotating member 32*a* respectively. When the first paper feed rotating member 31*a* is rotated in the counterclockwise direction in FIG. 1 by a driving unit (not shown), the top sheet of transfer paper P within the first paper feed cassette 31 is discharged to a paper feed path 33 disposed to extend in the vertical direction at the right side of the cassette. When the second paper feed rotating member 32*a* is rotated in the counterclockwise direction in FIG. 1 by a driving unit (not shown), the top sheet of transfer paper P within the second paper feed cassette 32 is discharged to the paper feed path 33. Plural pairs of conveyor rotating members 34 are disposed within the paper feed path 33. The transfer paper P sent to the paper feed path 33 is sandwiched between the pair of conveyor rotating members 34, and is conveyed from the lower side to the upper side in FIG. 1 within the paper feed path 33.

A pair of resist rotating members 35 is disposed at the end of the paper feed path 33. Immediately after sandwiching the transfer paper P sent from the pair of conveyor rotating members 34, the pair of resist rotating members 35 once stops rotating. Then, the pair of resist rotating members 35 sends the transfer paper P to a secondary transfer nip, described later, at a suitable timing.

A transfer unit 40 that endlessly moves an intermediate transfer belt 41 in the counterclockwise direction in FIG. 1 is disposed above the process units 1Y, 1C, 1M, and 1K. The transfer unit 40 includes a belt cleaning device 42, a first bracket 43, and a second bracket 44, in addition to the intermediate transfer belt 40. The transfer unit 40 also includes four primary transfer rotating members 45Y, 45C, 45M, and 45K, a secondary transfer backup rotating member 46, a driving rotating member 47, an auxiliary rotating member 48, a tension rotating member 49, and the like. The intermediate transfer belt 41 is endlessly moved in the counterclockwise direction in FIG. 1 by the rotation of the driving rotating member 47 while being spanned around the eight rotating members. The four primary transfer rotating members 45Y, 45C, 45M, and 45K and the photosensitive elements 2Y, 2C, 2M, and 2K sandwich the intermediate transfer belt 41 that is endlessly moved, between these rotating members and the photosensitive elements, thereby forming primary transfer nips respectively. A transfer bias having polarity (for example, positive) that is opposite to the polarity of the toner is applied to the back surface (loop inner surface) of the intermediate transfer belt 41. While the intermediate transfer belt 41 sequentially passes through the primary transfer nips for Y, C, M, and K due to its endless movement, Y, C, M, and K toner images on the photosensitive elements 2Y, 2C, 2M, and 2K are sequentially superimposed on the front surface of the intermediate transfer belt 41, thereby achieving a primary transfer of the images. As a result, a toner image having the four colors superimposed on each other (hereinafter, "four-color toner image") is formed on the intermediate transfer belt 41.

The secondary transfer backup rotating member 46 and a secondary transfer rotating member 50, disposed at the outside of the loop of the intermediate transfer belt 41, sandwich the intermediate transfer belt 41, thereby forming a secondary transfer nip. The pair of resist rotating members 35 sends the transfer paper P sandwiched between the rotating members, to the secondary transfer nip at timing synchronous with the four-color toner image on the intermediate transfer belt 41. The four-color toner image on the intermediate transfer belt 41 is collectively secondarily transferred onto the transfer paper P within the secondary transfer nip based on the influence of a secondary transfer electric field formed between the secondary transfer rotating member 50 to which the secondary transfer bias is applied and the secondary transfer backup rotating member 46 and the influence of a nip pressure. The secondarily transferred image and white color of the transfer paper P form a full-color toner image.

A transfer residual toner that is not transferred to the transfer paper P is kept adhered to the intermediate transfer belt 41 after the intermediate transfer belt 41 passes through the secondary transfer nip. The belt cleaning device 42 cleans the transfer residual toner on the belt.

A fixing device 60 that includes a pressing rotating member 61 and a fixing belt unit 62 is disposed above the secondary transfer nip in FIG. 1. The fixing belt unit 62 of the fixing device 60 is endlessly moved in the counterclockwise direction in FIG. 1 while stretching a fixing belt 64 with a heating rotating member 63, a tension rotating member 65, and a driving rotating member 66. The heating rotating member 63 includes a heat source such as a halogen lump, and heats the fixing belt 64 from the back surface. The pressing rotating member 61 that is rotated in the counterclockwise direction in FIG. 1 is brought into contact with the front surface of the heated fixing belt 64 to which the heating rotating member 63 is applied. With this arrangement, the fixing nip at which the pressing rotating member 61 and the fixing belt 64 contact is formed.

The transfer paper P that passes through the secondary transfer nip is separated from the intermediate transfer belt 41, and is then sent into the fixing device 60. While the transfer paper P is conveyed from the lower side to the upper side in FIG. 1 by being sandwiched by the fixing nip, the transfer paper P is heated and pressed by the fixing belt 64, and a full-color image is fixed.

The transfer paper P undergone a fixing process passes through a pair of discharge rotating members 67, and is discharged to the outside of the printer. A stack unit 68 is formed on an upper surface of a casing of a printer main body. The sheets of transfer paper P discharged by the pair of discharge rotating members 67 to the outside of the printer are sequentially stacked on the stack unit 68.

Four toner cartridges 100Y, 100C, 100M, and 100K that accommodate the Y, C, M, and K toners respectively are disposed above the transfer unit 40. The Y, C, M, and K toners in the toner cartridges 100Y, 100C, 100M, and 100K are suitably supplied to the developing devices of the process units 1Y, 1C, 1M, and 1K respectively. The toner cartridges 100Y, 100C, 100M, and 100K are detachably mounted on the printer main body independently of the process units 1Y, 1C, 1M, and 1K respectively.

In the printer having the above configuration, the toner image forming unit that forms a toner image on the transfer paper P as a recording medium is configured by a combination of the four process units 1Y, 1C, 1M, and 1K, the optical writing unit 20, the transfer unit 40, and the like.

Figure 3:
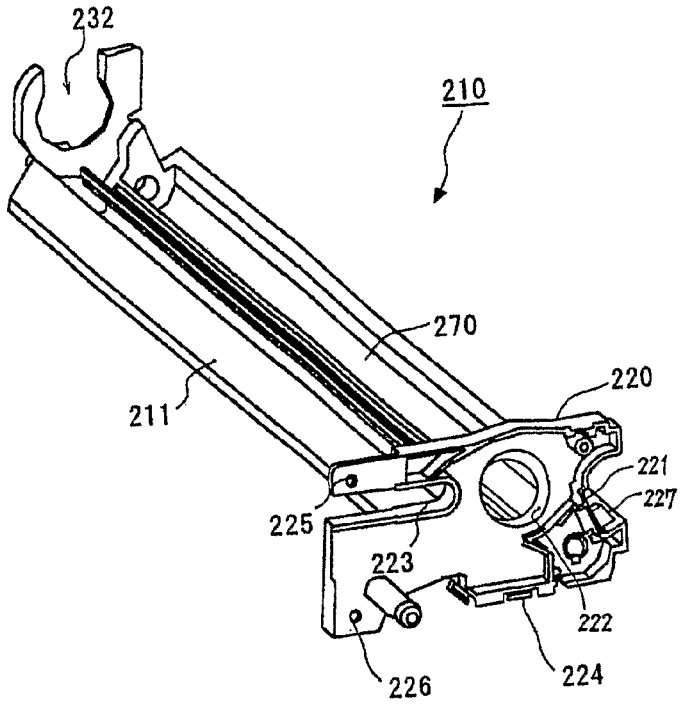
FIG. 3 is a schematic of a frame of the process unit.
Figure 4:
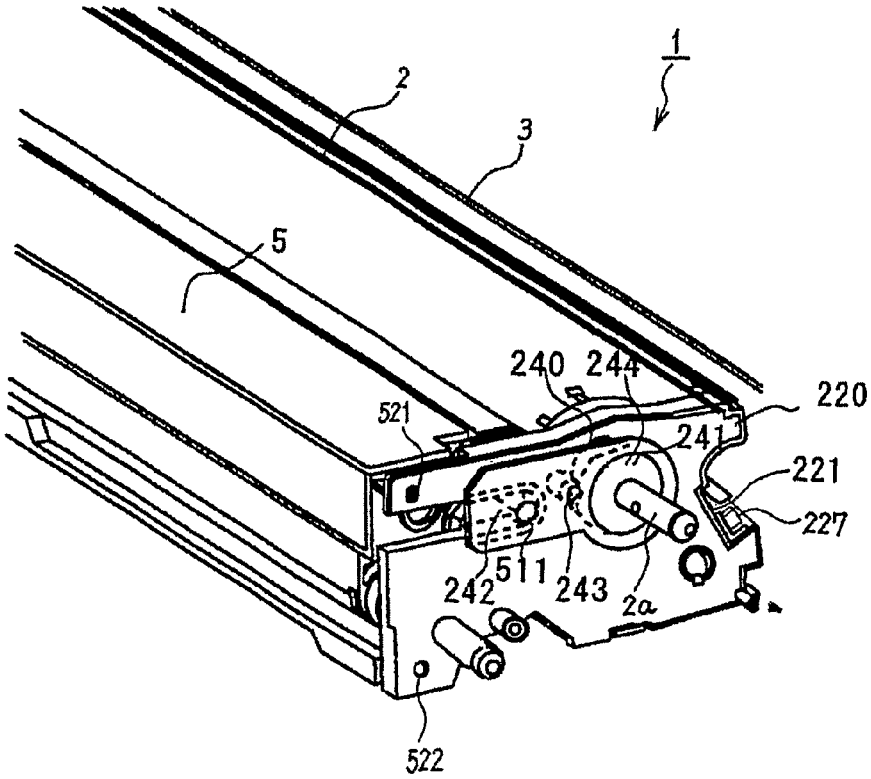
FIG. 4 is a schematic of the process unit observed from a side of a first side plate.

FIG. 3 depicts a frame 210 of the process unit 1. FIG. 4 depicts the process unit 1 observed from a first side plate 220. As shown in FIG. 3, the frame 210 of the process unit 1 includes a charge device positioning plate 211 that extends from the first side plate 220 at this side to the back in FIG. 3. The frame 210 includes a lubricant accommodating unit 270 that configures the lubricant coating device 6 and accommodates the solid lubricant 6*a*. The first side plate 220 is formed with a first positioning hole 222 as a rotating member positioning unit that positions the photosensitive element 2. The positioning hole 222 is engaged with a bearing 244, and the rotation axis 2*a* of the photosensitive element 2 is supported by the bearing 244 as shown in FIG. 4. As shown in FIG. 3, a provisional positioning portion 232 for provisionally positioning the photosensitive element 2 at the time of assembling the photosensitive element 2 is formed on the frame 210 at the back side of FIG. 3. A guide groove 223 into which the developing device 5 is mounted, and fitting holes 225 and 226 that are used to fit the developing device 5 to the frame 210 are formed at the left side of the first side plate 220 in FIG. 3. As shown in FIG. 4, a shaft 242 that extends from the developing rotating member of the developing device 5 is inserted into the guide groove 223, and a shaft 511 is inserted into the shaft inserting portion 242 of a face plate 240 indicated by a dotted line in FIG. 4. Fitting projections 521 and 522 that extend from the developing device 5 are inserted into the fitting holes 225 and 226. A hole 241 of the face plate 240 is engaged with the bearing 244. The face plate 240 is fixed to the first side plate 220 by meshing a screw with a screw hole 243 formed on the face plate 240.

As shown in FIG. 3, a first blade contact surface 221 that is in close contact with the holding plate 11*b* of the cleaning blade is formed on the right side of the side plate 220 of the frame 210 in FIG. 3. The first blade contact surface 221 has an approximately rectangular first boss 227 as a blade positioning unit that positions the cleaning blade 11. The fixing of the cleaning blade 11 to the frame 210, and the boss 227 are described later.

Figure 5:
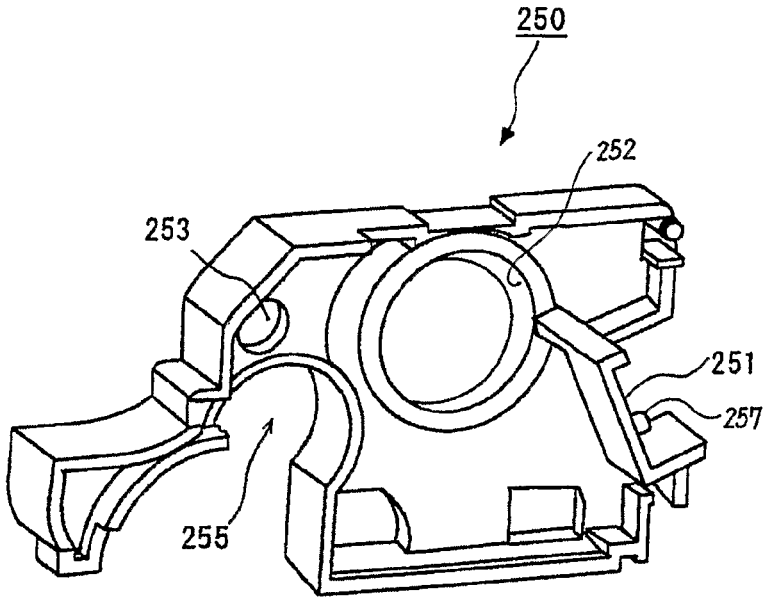
FIG. 5 is a schematic of a second side plate of the frame of the process unit.
Figure 6:
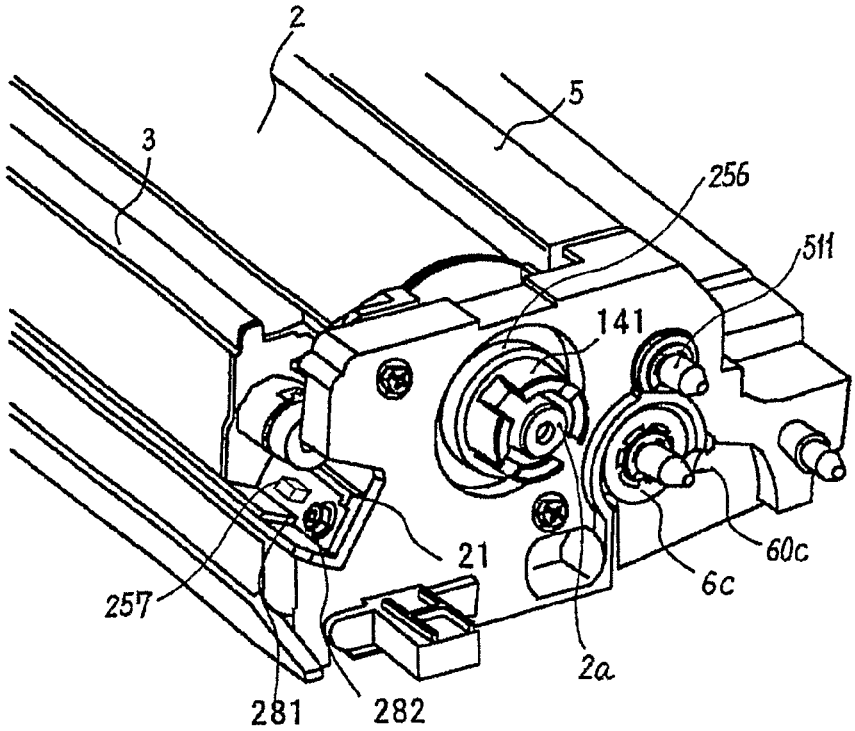
FIG. 6 is a schematic of the frame of the process unit observed from a side of the second side plate.

FIG. 5 depicts a second side plate 250 that is fit to the back of the frame 210 shown in FIG. 3. FIG. 6 depicts the process unit 1 observed from a side of the second side plate 250. As shown in FIG. 5, a second blade contact surface 251 that is in close contact with the holding plate 11*b* of the cleaning blade is formed on the right side of the second side plate 250 in FIG. 5. The second blade contact surface 251 has an approximately rectangular second boss 257 as a blade positioning unit that positions the cleaning blade 11. As shown in FIG. 6, the holding plate 11*b* of the cleaning blade 11 is fastened to the second blade contact surface 251 with a screw 282.

As shown in FIG. 5, the second side plate 250 has a second positioning hole 252 for positioning the photosensitive element 2. As shown in FIG. 6, a bearing 256 is engaged with the second positioning hole 252, and the rotation axis 2*a* of the photosensitive element 2 is supported by the bearing 256. As shown in FIG. 5, the second side plate 250 has a shaft supporting hole 253, thereby supporting the shaft 511 that extends from the developing rotating member of the developing device, as shown in FIG. 6. As shown in FIG. 5, the second side plate 250 has a brush rotating member guide groove 255. A rotation axis 60*c* of the brush rotating member 6*c* of the lubricant coating device 6 is guided to the brush rotating member guide groove 255.

As shown in FIG. 6, the rotation axis 2*a* of the photosensitive element 2 has a coupling 141 which is engaged with a driving unit (not shown) when the process unit 1 is fit to the device main body.

Figure 7:
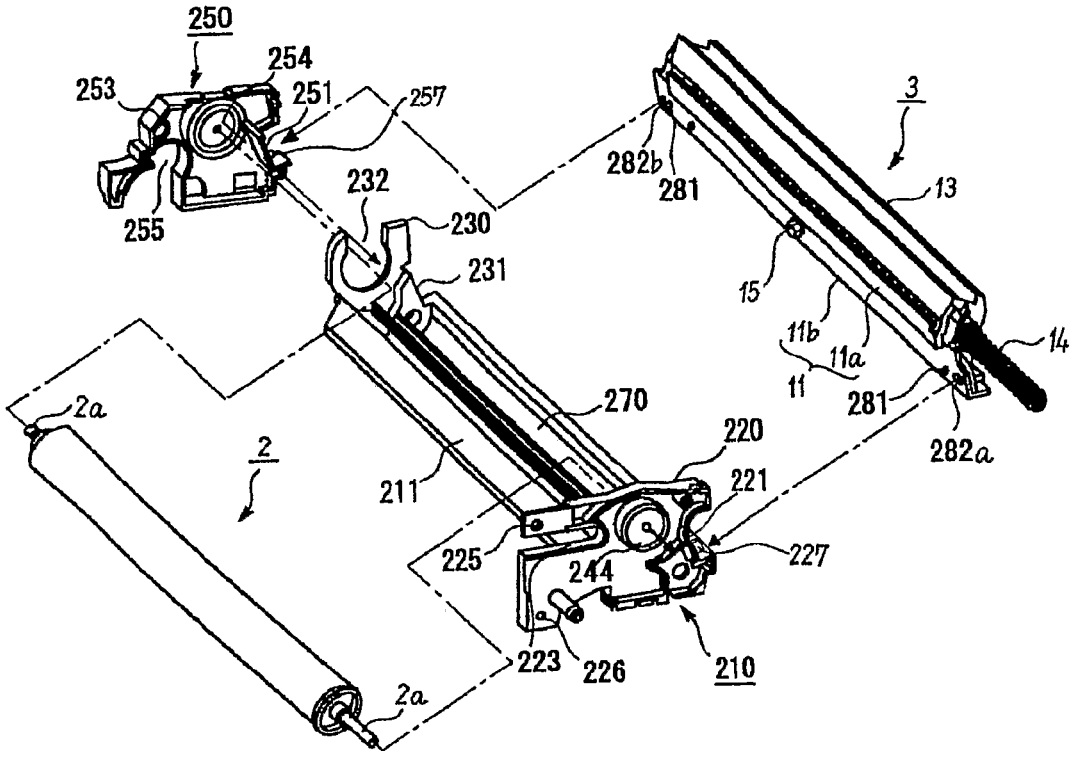
FIG. 7 is a schematic for explaining assembly of a photosensitive element and a cleaning device in the process unit.

Assembling of the process unit 1 is explained next. FIG. 7 is an explanatory diagram of assembling the photosensitive element 2 with the cleaning device 3. First, one side of the rotation axis 2*a* of the photosensitive element 2 is inserted into the bearing 244 of the first side plate 220, and the photosensitive element 2 is provisionally positioned within the frame 210 by the bearing 244 and the provisional positioning portion 232. Next, the other side of the rotation axis 2*a* of the photosensitive element 2 is inserted into the bearing 254 of the second side plate 250. With this arrangement, the photosensitive element 2 is positioned in the frame 210. Next, the first boss 227 is inserted into a first positioning hole 282*a* provided on the holding plate 11*b* of the cleaning blade 11, and the second boss 257 is inserted into a second positioning hole 282*b* of the holding plate 11*b*, thereby positioning the cleaning blade 11. After the cleaning blade 11 is positioned, the holding plate 12 is fastened to the contact surfaces 251 and 221 with screws, as shown in FIG. 6. After the cleaning blade 11 is fit to the frame 210, the solid lubricant 6*a* and the brush rotating member 6*c* that constitute the lubricant coating device 6 are fit to the frame 210, and the charger 4 is fit to the positioning plate 211 of the frame 210. The shaft 511 of the developing device 5 is inserted into the shaft supporting hole 253 and the guide groove 223 respectively, and the developing device 5 is fit to the frame 210 by using the face plate 250.

As explained above, according to the present embodiment, the cleaning blade 11 is directly fit to the frame 210 that supports the photosensitive element 2. Therefore, the cleaning blade 11 can be positioned on the photosensitive element in high precision.

Figure 8:
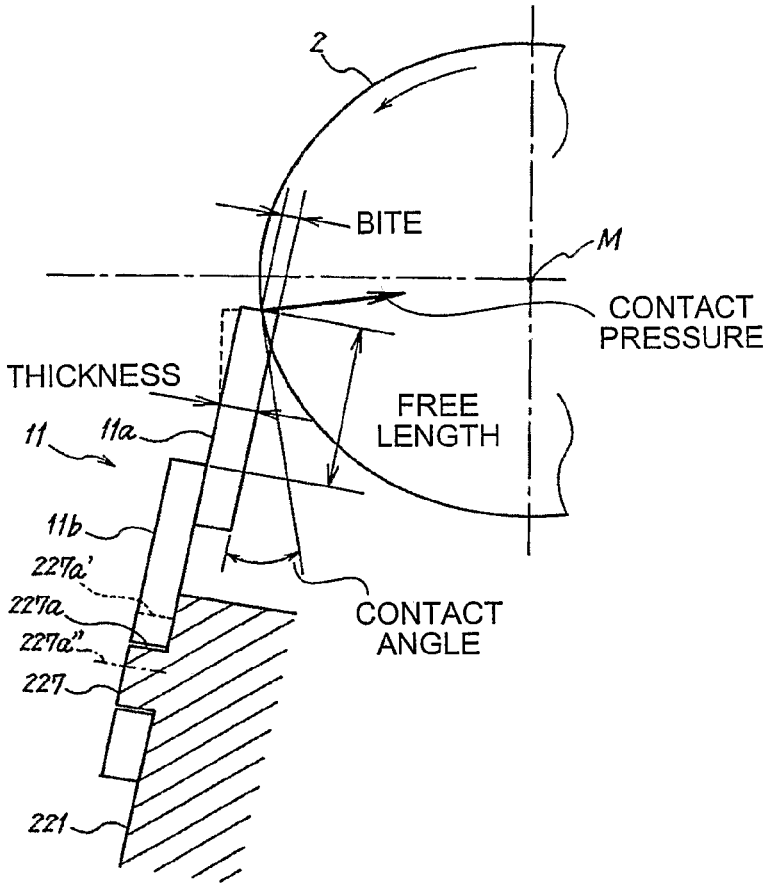
FIG. 8 is a schematic for explaining a contact state of the photosensitive element and a cleaning blade.

FIG. 8 depicts a state of contact between the photosensitive element 2 and the cleaning blade 11. While the first blade contact surface 221 is explained herein, the same explanation can be also applied to the second blade contact surface 251. As shown in FIG. 8, the state of contact of the cleaning blade 11 to the photosensitive element 2 has a large relation with the first blade contact surface 221 that extends in the axial direction parallel with the photosensitive element 2, and a first reference surface 227*a* as a supporting surface that supports the cleaning blade 11 of the first boss 227 provided on the first blade contact surface 221 such that the cleaning blade 11 does not move to the weight direction. In other words, the angle at which the cleaning blade 11 is brought into contact with the photosensitive element 2 is determined by a tilt angle of the blade contact surface 221 relative to a fitting reference position of the photosensitive element 2 (the center M of the photosensitive element positioning hole 222). Further, the position of the cleaning blade 11 in the up and down directions relative to the position of the first reference surface 227*a* of the boss 227 to the photosensitive element 2 is determined. The contact angle of the cleaning blade 11 relative to the photosensitive element and the positioning of the cleaning blade in the up and down directions determine the bite and contact pressure of the cleaning blade 11 against the photosensitive element 2.

In the present embodiment, a polymer toner having substantially a spherical shape with a small diameter is used to obtain high image quality. The substantially spherical polymer toner with a small diameter increases the Van der Waals force to the photosensitive element 2, thereby increasing adhesive force to the photosensitive element 2. As a result, even when the front end of the cleaning blade 11 is slightly curled or has slight vibration, there is a possibility that the polymer toner cannot be scraped off. Therefore, the cleaning blade 11 needs to be brought into contact with the photosensitive element 2 in high precision so that contact conditions such as the contact pressure, the bite, and the contact angle with respect to the photosensitive element 2 are within an optimum range. Specifically, the bite of the cleaning blade to the photosensitive element needs to be restricted to equal to or below ±25 micrometers (μm). The contact condition of the cleaning blade 11 to the photosensitive element 2 changes greatly depending on the fitting position of the cleaning blade 11 on the frame 210 and the fitting position of the photosensitive element 2 on the frame 210.

This is explained in detail below. When the first reference surface 227*a* of the boss 227 is positioned above the reference position 227*a* shown by a solid line as indicated by a dotted line 227*a*' due to a manufacturing error or the like, a bite and a contact pressure increase. As a result, vibration and curling occur, thereby causing a cleaning failure. Further, when the first reference surface 227*a* of the boss 227 is positioned below the reference position shown by the solid line as indicated by a dashed line 227*a*" in FIG. 8 due to a manufacturing error or the like, the bite and the contact pressure decrease. As a result, the cleaning blade 11 cannot remove the polymer toner from the photosensitive element 2, which may lead to a cleaning failure.

To accurately position the photosensitive element 2 with respect to the first reference surface 227*a* of the boss 227, it is preferable that at least the first reference surface 227*a* of the boss 227 is made by the same mold as that used to form the positioning hole 222 for positioning the photosensitive element 2. When the positioning hole 222 and the first reference surface 227*a* are formed by using the same mold, the error between the positioning hole 222 and the first reference surface 227*a* is only the manufacturing error of the mold. Consequently, there occurs no assembling error of the mold, unlike the error that occurs when the positioning hole 222 and the first reference surface 227*a* are formed using separate molds. As a result, the positioning hole 222 and the first reference surface 227*a* can be manufactured in high precision, as compared with forming the positioning hole 222 and the first reference surface 227*a* by using separate molds.

Figure 9:
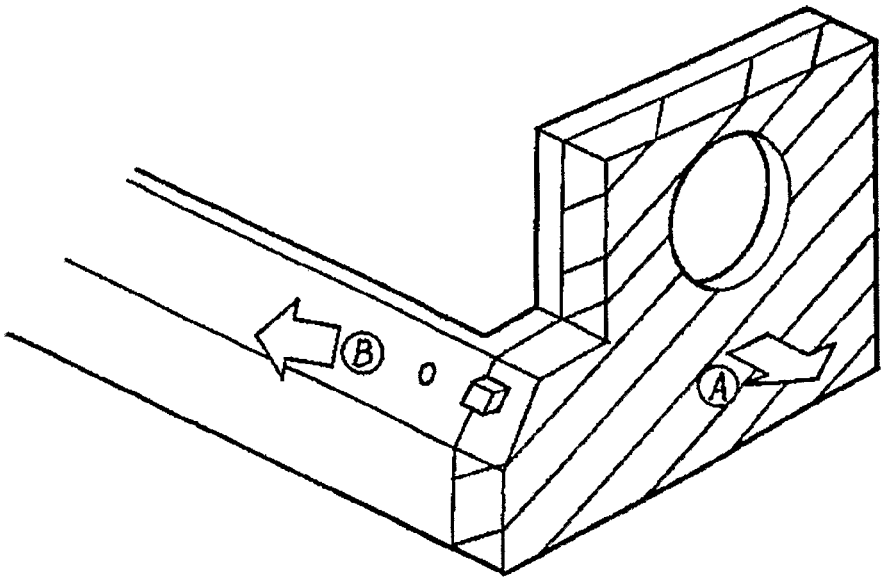
FIG. 9 is a schematic of a frame part formed by a first mold and a frame part formed by a second mold.

The frame 210 is made of resin, by injection molding a melted resin in the mold. FIG. 9 is a schematic diagram of a frame part formed by a first mold (indicated by a shaded part) and a frame part formed by a second mold. As shown in FIG. 9, the first mold mainly forms the first side plate 220 of the frame. Specifically, the first mold forms the photosensitive element positioning hole 222 and a part of the first blade contact surface 221, thereby forming the first boss 227. The second mold mainly forms a part of the frame 210 that extends in the axial direction. After forming the frame, the first mold is moved to this side in FIG. 9, and is removed from the frame 210 to form the photosensitive element positioning hole 222. On the other hand, after forming the frame, the second mold is moved to the left side in FIG. 9, and is removed from the frame 210.

Figure 10A:
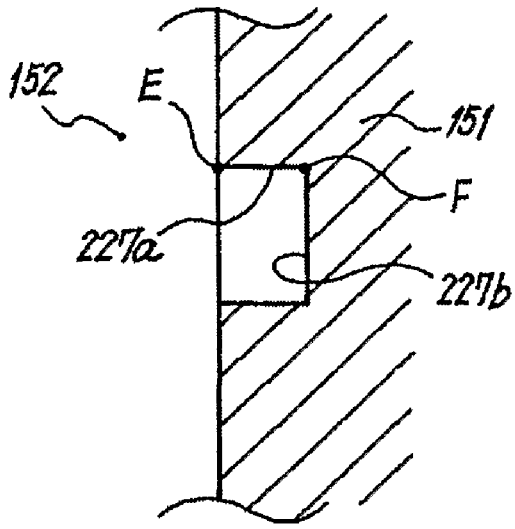
FIG. 10A is a cross-section of a molded state (1) of a first boss.
Figure 10B:
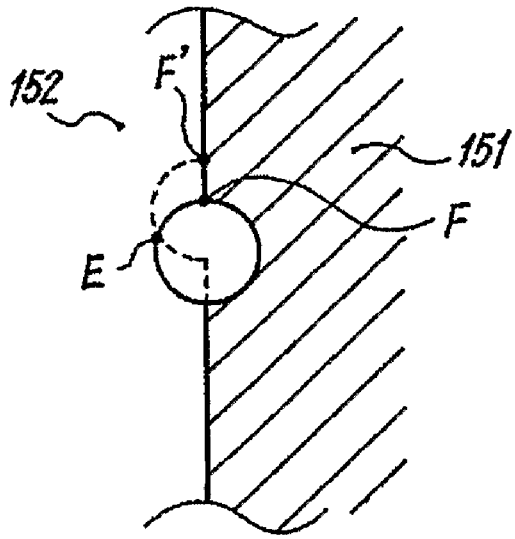
FIG. 10B is a cross-section of a molded state (2) of the first boss.

FIG. 10A and FIG. 10B are cross-sections for illustrating molded states of the first boss 227. FIG. 10A depicts a molded state of a first rectangular boss according to the embodiment. FIG. 10B depicts a molded state of a conventional circular boss. A reference numeral 151 shown in FIG. 10A and FIG. 10B denotes the first mold, and 152 denotes the second mold.

As shown in FIG. 10B, when the boss is circular and when the boss is formed so that the first mold can be extracted, the first mold needs to form a half of the boss, and the second mold needs to form the rest half of the boss. In other words, since a point F is present at a higher position than a point E at the downstream of the extraction direction of the first mold 151, the first mold 151 cannot be extracted to a direction of D after molding up to the point E. When the first mold 151 and the second mold 152 are used to form the circular first boss 227, the second mold 152 has a possibility of being deviated upward as shown by a dotted line due to an assembly error of the second mold 152. As a result, the cleaning blade 11 is positioned at F' in FIG. 10B, and the cleaning blade cannot be positioned accurately to the photosensitive element.

On the other hand, according to the present embodiment, as shown in FIG. 10A, the first boss 227 has a rectangular shape and the first reference surface 227*a* has a flat shape. Since the height of the first reference surface 227*a* at the downstream of the mold extraction direction becomes equal to the height of the first reference surface 227*a* at the upstream of the mold extraction direction, the first mold 151 can be extracted in the direction of D.

Figure 11A:
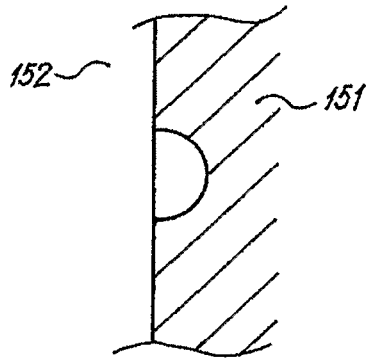
FIG. 11A is a schematic of a modification (1) of the boss.
Figure 11B:
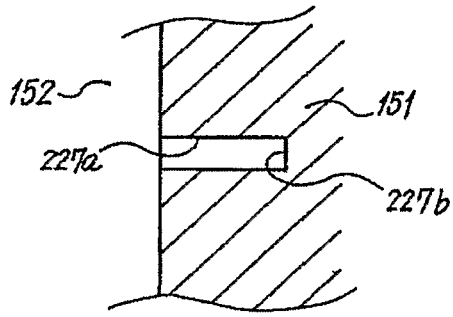
FIG. 11B is a schematic of a modification (2) of the boss.
Figure 11C:
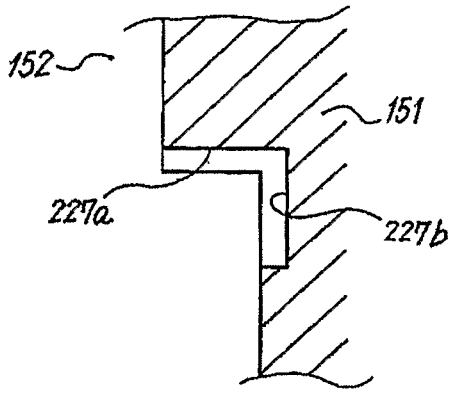
FIG. 11C is a schematic of a modification (3) of the boss.
Figure 11D:
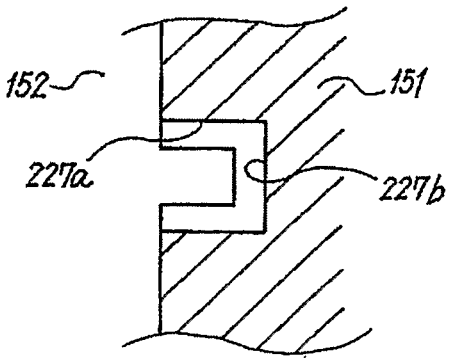
FIG. 11D is a schematic of a modification (4) of the boss.

The first reference surface 227*a* of the first boss 227 can have any shape as long as the height of the first reference surface gradually decreases toward the first side plate or the first reference surface has a flat surface. The first reference surface 227*a* can have a semicircular shape as shown in FIG. 11A or a rectangular solid shape having a large length in the axial direction as shown in FIG. 11B. Alternatively, the first reference surface 227*a* can have a uniform shape as shown in FIG. 11C or a U shape as shown in FIG. 11D. As explained above, if the height of the first reference surface 227*a* gradually decreases toward the first side plate or the first reference surface has a flat surface, the first reference surface 227*a* can be formed by using only the first mold. As a result, the first reference surface 227*a* and the photosensitive element positioning hole 222 can be formed by the first mold, and the cleaning blade 11 can be positioned to the photosensitive element 2 in high precision.

Preferably, the first reference surface 227*a* has a flat part as shown in FIG. 11B to FIG. 11D. When the first reference surface 227*a* has a semicircular shape as shown in FIG. 11A, the first reference surface becomes a point X, and it is difficult to form the point X in high precision. In other words, since only the point X becomes a reference position of the cleaning blade, it is difficult to position this point X in the positioning hole of the photosensitive element in high precision. Therefore, it is difficult to manufacture a mold to obtain the positional relationship between the positioning hole 222 and the first reference surface 227*a* in high precision. On the other hand, when the first reference surface 227*a* has a flat surface as shown in FIG. 11B to FIG. 11D, the first reference surface 227*a* and the photosensitive element positioning hole 222 can be positioned in high precision at the time of manufacturing the mold. Therefore, a mold that satisfies a positional relation between the positioning hole 222 and the first reference surface 227*a* in high precision can be manufactured.

A surface 227*b* of the boss at the first side plate side becomes a second reference surface as a positioning unit that positions the cleaning blade 11 to the photosensitive element in the axial direction. Therefore, when the second reference surface 227*b* is also formed by the first mold 151 that forms the photosensitive element positioning hole 222 for positioning the photosensitive element 2, the cleaning blade 11 can be positioned in the axial direction in high precision. When the second reference surface 227*b* of the boss is formed to extend straight to a lower side as shown in FIG. 10A, FIG. 10B, FIG. 11C, and FIG. 11D, the photosensitive element positioning hole 222 and the second reference surface 227*b* can be positioned in high precision at the time of manufacturing the mold.

When the first reference surface is sufficiently long, the cleaning blade 11 can be positioned using only the first boss.

While the molding of the first boss 227 is explained above, this method can be also applied to the second boss 257.

As shown in FIG. 8, preferably, the elastic plate 11*a* of the cleaning blade is fixed to the same surface of the holding plate 11*b* to which the first blade contact surface 221 is closely contacted. When the elastic plate 11*a* is fixed to the same surface of the holding plate 11*b* to which the first blade contact surface 221 is closely contacted, a variation in the thickness of the holding plate 11*b* can be disregarded. Therefore, the cleaning blade 11 can be brought into contact with the photosensitive element 2 in high precision.

A toner that can be suitably applied to the image forming apparatus according to the present embodiment is explained next. In the present embodiment, a highly circular polymer toner having a small particle diameter is used. Specifically, a toner meeting the following conditions (a) to (d) is preferable.

(a) An average circularity is 0.90 to 0.99.

(b) A shape coefficient SF-1 is 120 to 180.

(c) A shape coefficient SF-2 is 120 to 190.

(d) A particle size distribution (volume average particle diameter Dv/number average particle diameter Dn) is 1.05 to 1.30.

As a method of instructing a user to use a particle meeting the above conditions, a toner meeting all the conditions (a) to (d) can be packaged with the printer to be shipped to the user. Alternatively, a manufacturing number and a product name of the toner can be specified on the printer main body or on an instruction manual of the printer. Alternatively, the product number and the product name can be notified to the user by a document, email data, or the like. Alternatively, the toner bottle (BY, BM, BC, BK) as a toner accommodating unit that accommodates the toner can be set to the printer main body to be shipped in this state. While the printer according to the present embodiment uses all of these methods, any one of the above methods is sufficient.

The toner meeting the condition (a) is assigned for the following reason. When the toner has an average circularity less than 0.90, that is, when the toner has an irregular shape rather than a spherical shape, transferability is deteriorated rapidly, and a transfer toner scattering occurs easily at the electrostatic transfer time. When the toner has an average circularity less than 0.90, it becomes difficult to form a high-precision image having reproducibility of proper concentration. When the toner has an average circularity exceeding 0.99, a cleaning failure of an object to be cleaned such as the photosensitive element and the intermediate transfer belt occurs in an apparatus employing blade cleaning, and the image is easily deteriorated. At the time of outputting an image having a relatively low image area rate, there is little transfer residual toner, and the cleaning failure is less likely to become a trouble. However, at the time of outputting a color photographic image having a high image area rate or when an image not yet transferred remains on the photosensitive element due to a paper feeding failure and the like, the cleaning failure occurs easily. A more preferable range of an average circularity is 0.93 to 0.97. It is more preferable to limit the amount of a toner particle having circularity less than 0.94 to equal to or less than 10 percent.

The average circularity of the toner can be measured as follows. First, a slurry containing toner particles to be tested is passed through an imaging unit detecting belt on a flat plate, and a charge-coupled device (CCD) camera optically picks up a particle image. For each particle image, a peripheral length of a circle having an equivalent projected area is divided by a peripheral length of an actual particle, thereby calculating an average value. This average value is the average circularity. To measure the average circularity, for example, a flow particle image analyzer FPIA-2100 (manufactured by Toa Medical Electronic Co., Ltd.) can be used. When this analyzer is used, a surfactant, preferably, alkyl benzene sulfonate, is added by 0.1 milliliter (mm) to 0.5 mm, as a dispersant, to water of 100 mm to 150 mm having impurity solid removed in advance from a container. Further, the tested toner is added by about 0.1 gram to 0.5 gram. This slurry is dispersed by an ultrasonic disperser for about one to three minutes, thereby adjusting the concentration of the dispersion liquid to 30,000/μl to 10,000/μl. This dispersion liquid is applied to the analyzer to measure the shape and the distribution of the toner.

Figure 12:
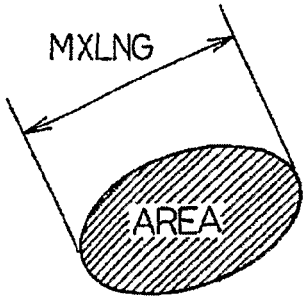
FIG. 12 is a schematic for explaining a shape coefficient SF-1.

The toner meeting the condition (b) or (c) is assigned for the following reason. The shape coefficient SF-1 and the shape coefficient SF-2 are parameters that express the shape of a toner, and are well known in the micrometrics field. The shape coefficient SF-1 indicates roundness of a spherical substance such as a toner particle. As shown in FIG. 12, the spherical substance is projected on a two-dimensional plane. A maximum diameter length MXLNG of an oblong obtained based on this projection is squared, and this squared value is divided by an area AREA. The result is multiplied by $100\pi/4$. In other words, the shape coefficient SF-1 can be given by the following expression. When the shape coefficient SF-1 is 100, this spherical substance is a true sphere. When the value of SF-1 becomes larger, the shape of the spherical substance becomes amorphous.

$$\text{Shape coefficient } SF\text{-}1=\{(\text{MXLNG})^2/\text{AREA}\}\times(100\pi/4)$$

Figure 13:
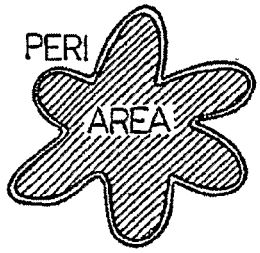
FIG. 13 is a schematic for explaining a shape coefficient SF-2.
Figure 14:
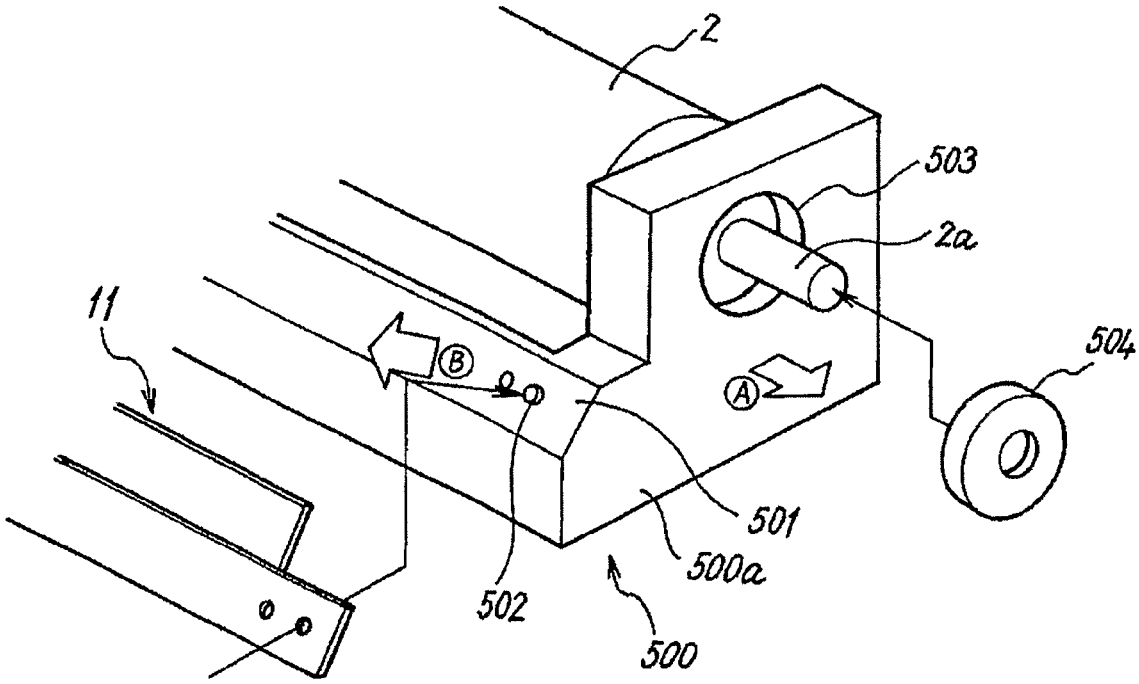
FIG. 14 is a schematic of a unit to which a photosensitive element and a cleaning blade are integrally installed.

The shape coefficient SF-2 indicates a concavo-convex level on the surface of the spherical substance. As shown in FIG. 13, the spherical substance is projected on a two-dimensional plane. A peripheral length PERI of a shape obtained based on this projection is squared, and this squared value is divided by an area AREA. The result is multiplied by $100/4\pi$. In other words, the shape coefficient SF-2 can be given by the following expression. When the shape coefficient SF-2 is 100, this spherical substance has no concavity or convexity on its surface. When the value of the shape coefficient SF-2 becomes larger, the concavity and convexity of the surface of the spherical substance becomes extreme.

$$\text{Shape coefficient } SF\text{-}2=\{(\text{PERI})^2/\text{AREA}\}\times(100\pi/4)$$

It is made clear by a study carried out by the inventor of the present invention that when the toner shape becomes close to a true sphere (when SF-1 and SF-2 become close to 100), the transfer efficiency becomes high. This is considered because when the toner shape becomes close to the true sphere, a contact area between the toner particle and the contact substance (such as between toner particles, and between the toner particle and the image carrier) becomes small. As a result, toner fluidity increases, or adsorptive force to a substance (reflection) becomes weak, and the influence of a transfer electric field can be received easily. It is made clear by the study carried out by the present inventor that, when the shape coefficient SF-1 exceeds 180 and when the shape coefficient SF-2 exceeds 190, the transfer efficiency rapidly starts to deteriorate.

However, when the toner shape becomes close to the true sphere, this works disadvantageously to a mechanical cleaning (such as a blade cleaning). This is considered because the toner becomes higher in fluidity to easily pass through a small gap between a cleaning member and a cleaned substance. According to the study carried out by the present inventors, when the shape coefficient SF-1 and the shape coefficient SF-2 become lower than 120, cleanability suddenly starts to deteriorate.

The shape coefficient SF-1 and the shape coefficient SF-2 can be also obtained as follows. The FE-SEM (S-800) manufactured by Hitachi Ltd., is used to sequentially pick up images of 100 toner particles selected at random. Image information is introduced to an image analyzer (LUSEX3) manufactured by NIRECO Corporation, thereby obtaining MXLING, AREA, and PERI. As a result, an average value of the shape coefficient per 100 toner particles is calculated by the above expression.

The toner meeting the condition (d) is assigned for the following reason. The particle distribution (volume average particle diameter Dv/number average particle diameter Dn) is one parameter that expresses the toner particle distribution. A dry toner having the volume average particle diameter Dv/number average particle diameter Dn of 1.05 to 1.30, preferably 1.10 to 1.25, has a narrow distribution of toner particles. Therefore, there are various advantages of this toner.

For example, when the volume average particle diameter Dv is 4 μm to 8 μm and also when the volume average particle diameter Dv/number average particle diameter Dn is 1.05 to 1.30, the powder toner has the following advantage. Since a phenomenon that a toner particle having a particle diameter suitable for the pattern of an electrostatic latent image contributes to development in preference to other toners progresses, images of various patterns can be formed stably. When the apparatus employs a configuration of recovering a toner that remains on the image carrier such as the photosensitive element and using again the recovered toner, a larger volume of toner particles having a small size that cannot be transferred easily are recycled. When a toner having a relatively high particle distribution is recycled, a large variation in particle sizes occurs during a period from toner replenishment to the next toner replenishment, thereby adversely influencing the development performance. When the volume average particle diameter Dv of a toner is smaller than the above range, and when this toner is used for a two-component developing agent, the toner is adhered to the surface of a carrier during a long-period stirring in the developing device, thereby decreasing the charging capacity of the carrier. When this toner is used for a one-component developing agent, a filming of the toner on the developing rotating member and a fusion of the toner on the part such as the blade for thinning the toner layer occur easily. On the other hand, when the volume average particle diameter Dv of the toner is larger than the above range, it becomes difficult to obtain a high-resolution and high-quality image. Further, when a toner is supplied to the developing agent, the particle diameter of the toner varies greatly.

The particle distribution of the toner can be also measured by a measuring device according to a Coulter counter method, such as a Coulter counter TA-II and a Coulter Multisizer II (manufactured by Beckman Coulter Corporation). Specifically, a surfactant (preferably, alkyl benzene sulfonate) is added by 0.1 mm to 5 mm, as a dispersant, to an electrolytic solution of 100 to 150 milliliters. The electrolytic solution of about one percent NaCl solution is prepared by using first-class sodium chloride. For example, ISOTON-II (manufactured by Beckman Coulter Corporation) can be used. A measuring sample of 2 to 20 milligrams is further added to the obtained solution. This solution is dispersed by an ultrasonic disperser for about one to three minutes. The above measuring device is used to measure the volume and the number of toner particles or toner using a 100 μm aperture, thereby calculating a volume distribution and a number distribution. The volume average particle diameter Dv and the number average particle diameter Dn of the toner can be obtained from the obtained distribution. 13 channels are used to measure toner particles having a particle size equal to or above 2.00 μm and less than 40.30 μm. The thirteen channels include sizes having a range from 2.00 μm to less than 2.52 μm, a range from 2.52 μm to less than 3.17 μm, a range from 3.17 μm to less than 4.00 μm, a range from 4.00 μm to less than 5.04 μm, a range from 5.04 μm to less than 6.35 μm, a range from 6.35 μm to less than 8.00 μm, a range from 8.00 μm to less than 10.08 μm, a range from 10.08 μm to less than 12.70 μm, a range from 12.70 μm to less than 16.00 μm, a range from 16.00 μm to less than 20.20 μm, a range from 20.20 μm to less than 25.40 μm, a range from 25.40 μm to less than 32.00 μm, and a range from 32.00 μm to 40.30 μm.

While the positioning of the cleaning blade to the photosensitive element within the process unit is explained in the present embodiment, the positioning is not limited to this. For example, the method of the present invention can be also applied to the positioning of a separation plate to the fixing rotating member within the fixing unit. In this case, the positioning unit that positions the fixing rotating member of the fixing unit and the positioning unit that positions the separation plate of the fixing unit are manufactured by the same mold, thereby increasing the precision of the positioning of the separation plate to the fixing unit. The method of the present invention can be also applied to the positioning of the doctor blade to the developing rotating member within the developing unit. In this case, the positioning unit that positions the developing rotating member of the developing unit and the positioning unit of the doctor blade of the developing unit are manufactured by the same mold. With this arrangement, the doctor blade can be positioned to the developing rotating member in high precision.

While the method of the present invention is applied to the cleaning blade that cleans the residual toner on the surface of the photosensitive element in the present embodiment, the method can be also applied to the cleaning blade that cleans the secondary transfer residual toner on the intermediate transfer belt 41.

The unit according to the present embodiment has the following effects.

First, the positioning hole as the rotating member positioning unit that positions the rotating member of the frame and the blade positioning unit that positions the blade member are formed by the same mold. With this arrangement, there is no assembling error of molds, unlike the error that occurs when the rotating member positioning unit and the blade positioning unit are formed using separate molds. As a result, precision of positioning of the blade positioning unit and the rotating member positioning unit can be increased.

Second, the blade positioning unit is a projecting portion (the boss) that projects from the surface of the frame extending in a longitudinal direction. The height of the first reference surface as the supporting surface that supports the blade member of the boss to prevent the blade member from moving to a weight direction is set equivalent in the longitudinal direction or is set gradually lower toward the side plate of the frame. The first reference surface becomes the positioning surface for determining the position of the blade member in up and down directions. Therefore, when the first reference surface is formed by the first mold that forms the positioning hole, the positioning error between the positioning hole and the first reference surface can be limited to only the mold manufacturing error.

Since the first mold forms the positioning hole on the side plate of the frame, the first mold needs to be moved in the longitudinal direction. When the first mold is not moved in the longitudinal direction, the part of the first mold that forms the positioning hole cannot be extracted from the formed frame. When the height of the first reference surface in the longitudinal direction is set equal or gradually lower toward the direction of the side plate, the first mold can be extracted in the longitudinal direction without being stuck by the formed first reference surface. As a result, the first mold can form both the first reference surface and the positioning hole, thereby making it possible to position the blade member to the photosensitive element in high precision.

When the height of the first reference surface in the longitudinal direction is set equal, the first reference surface can be positioned to the positioning hole in high precision. When the height of the first reference surface in the longitudinal direction decreases to form a slope toward the side plate, the blade member is positioned to the first reference surface at the highest point. Therefore, the mold can be manufactured by positioning the blade member to the positioning hole at this point. However, when the measuring position is deviated, the height is changed, and the mold cannot be manufactured by positioning the first reference surface to the first positioning hole in high precision. However, when the height of the first reference surface in the longitudinal direction is set equal, the height is not changed even when the measuring position is deviated. Therefore, the first reference surface and the first position hole can be positioned in high precision.

Third, one surface of the blade member is closely contacted to the surface (blade contact surface) of the frame that extends in the longitudinal direction. With this arrangement, the posture of the blade member to the frame is determined. Therefore, when the blade contact surface is formed so that the blade member can be contacted to the rotating member at a predetermined angle and also when the blade member is fit to the frame by closely contacting the blade member to the blade contact surface, the following advantages can be obtained. The blade member can be fit to the frame in the posture that the blade member is contacted to the rotating member at a predetermined angle, and the blade member can be contacted to the rotating member in high precision.

Fourth, the elastic plate of the blade member is fixed to the contact surface of the holding plate that is contacted to the blade contact surface. When the elastic plate is fixed to the same surface as that of the holding plate on which the blade is contacted, a variation in the thickness of the holding plate can be disregarded. Therefore, the blade member can be positioned to the rotating member in high precision, and the blade member can be contacted to the rotating member in high precision.

Fifth, the rotating member is a photosensitive element as an image carrier of which surface moves while holding a toner image. The blade member is a cleaning blade that cleans a transfer residual toner remaining on the surface of the image carrier after an image transfer process. With this arrangement, the cleaning blade can be positioned to the photosensitive element in high precision. Therefore, the cleaning blade can be contacted to the photosensitive element in high precision. As a result, the cleaning blade can satisfactorily remove a highly circular polymer toner having a small particle size, without curling the blade or without vibration, thereby suppressing a cleaning failure.

Sixth, the rotating member is an intermediate transfer belt as a belt-shaped image carrier, and the blade member is a cleaning blade that cleans the secondary transfer residual toner remaining on the intermediate transfer belt after a secondary transfer process. With this arrangement, the cleaning blade can be positioned to the intermediate transfer belt in high precision. Therefore, the cleaning blade can be contacted to the intermediate transfer belt in high precision. As a result, the cleaning blade can satisfactorily remove a highly circular polymer toner having a small particle size, without curling the blade or without vibration, thereby suppressing a cleaning failure.

Seventh, a cleaning failure can be suppressed by using the unit described in the fifth or the sixth effect, thereby suppressing the occurrence of an abnormal image due to a transfer residual toner that cannot be removed by the cleaning blade.

Eighth, a toner image is formed by using a polymer toner. When a highly circular polymer toner having a small particle size is used, a high-definition image with excellent dot reproducibility can be obtained.

Ninth, according the method of manufacturing the unit frame according to the present embodiment, the rotating member positioning unit of the frame and the blade positioning unit are manufactured by the same mold. With this arrangement, it is possible to manufacture the unit frame that can achieve positioning in high precision by the blade positioning unit and the rotating member positioning unit.

Tenth, according the method of manufacturing the unit frame according to the present embodiment, of the surfaces that form the boss, at least the supporting surface that supports the blade member of the boss to prevent the blade member from moving to a weight direction is formed by the first mold that forms the rotating member positioning unit. Since this supporting surface becomes the surface for positioning the blade member in the up and down directions, when this supporting surface is formed by the first mold, the positioning error between the rotating member positioning unit and the supporting surface can be limited to only the mold manufacturing error. With this arrangement, the frame that achieves positioning of the blade member to the rotating member in the up and down directions in high precision can be obtained.

Eleventh, according to the unit of the present embodiment; of the surfaces that form the boss, the surface of the frame at the side plate side is formed by the first mold. The surface of the frame of the blade position unit at the side plate side becomes the part for positioning the blade member to the rotating member in the axial direction. Therefore, when this surface is formed by the first mold, the positioning error between the rotating member positioning unit and the surface of the blade positioning unit at the side plate side can be limited to only the mold manufacturing error. With this arrangement, the frame that achieves positioning of the blade member to the rotating member in the axial directions in high precision can be obtained.

INDUSTRIAL APPLICABILITY

As explained above, the unit, the image forming apparatus, and the method of manufacturing a unit frame according to the present invention are suitable for image forming apparatuses such as a copying machine, a printer, and a facsimile device. Particularly, the present invention is suitable for units and apparatuses to improve positioning precision of assembling by integrally forming the rotator positioning unit and the blade positioning unit.

The invention claimed is:

1. A unit comprising:

an image carrier;

a cleaning device including an elastic plate that abuts the image carrier and extends substantially parallel to a length direction of the image carrier, and a holding plate that holds the elastic plate and having a first positioning hole; and a frame to which the image carrier and the cleaning device are installed, the frame including a side plate arranged orthogonal to the image carrier, the side plate being formed by injection molding melted resin in a mold, the side plate having an orthogonal surface that is orthogonal to the length direction, the side plate being provided with a second positioning hole in the orthogonal surface, a bearing holding a rotation axis of the image carrier and being configured to be fit in the second positioning hole, thereby positioning the image carrier with respect to the frame, a parallel surface extending parallel to the length direction, the side plate being provided with a projecting portion in the parallel surface and the projecting portion is configured to be inserted in the first positioning hole of the holding plate, thereby positioning the cleaning device with respect to the frame; wherein the side plate, having the second positioning hole and the projecting portion, is formed with a single mold that moves along the length direction, and a supporting surface, which is a part of the parallel surface on which the holding plate rests so that the cleaning device does not move in a direction of gravity, is parallel to the length direction.

2. The unit according to claim 1, wherein the image carrier is configured to carry a toner image on a surface thereof, and the elastic plate is configured to clean residual toner remaining on the surface of the image carrier after an image transfer process.

3. The unit according to claim 2, wherein the image carrier has a belt shape.

4. An image forming apparatus comprising a unit according to claim 3, wherein the unit is detachably arranged in the image forming apparatus.

5. An image forming apparatus comprising a unit according to claim 2, wherein the unit is detachably arranged in the image forming apparatus.

6. The image forming apparatus according to claim 5, wherein a toner that forms the toner image is a polymer toner.

7. A method of manufacturing, comprising:

injection molding melted resin into a single mold to form a side plate of a frame to which an image carrier and a cleaning device are to be installed, the cleaning device including an elastic plate configured to abut the image carrier and extend substantially parallel to a length direction of the image carrier, when the image carrier and the cleaning device are installed in the frame, the cleaning device further including a holding plate that holds the elastic plate and having a first positioning hole, the side plate to be arranged orthogonal to an axis of the image carrier when the image carrier is installed in the frame, the side plate having an orthogonal surface that is orthogonal to a length direction of the frame which is a same direction as the length direction of the image carrier, the side plate including a second positioning hole in the orthogonal surface, the second position hole for receiving a bearing that holds a rotation axis of the image carrier, thereby positioning the image carrier with respect to the frame, the side plate including a parallel surface extending parallel to the length direction of the frame, the parallel surface including a projection configured to be inserted in the first positioning hole of the holding plate, thereby positioning the cleaning device with respect to the frame, the method further comprising removing the side plate which has been formed by the single mold by moving, relative to the resin, the single mold in a direction which is parallel to an axis of the second positioning hole.

* * * * *